US005079940A

United States Patent [19]

Pulver et al.

[11] Patent Number: 5,079,940

[45] Date of Patent: Jan. 14, 1992

[54] ROLL GROOVING APPARATUS

[75] Inventors: Dale A. Pulver, Fairview Park; Colman A. Gulden, North Olmstead; Paul W. Gress, Bay Village, all of Ohio

[73] Assignee: Emerson Electric Co., St. Louis, Mo.

[21] Appl. No.: 731,385

[22] Filed: Jul. 17, 1991

Related U.S. Application Data

[63] Continuation of Ser. No. 545,280, Jun. 28, 1990, abandoned.

[51] Int. Cl.[5] ..... B21D 17/04

[52] U.S. Cl. ..... 72/105

[58] Field of Search ..... 72/102, 105, 106; 74/96; 82/86

[56] References Cited

U.S. PATENT DOCUMENTS

| | | | |
|---|---|---|---|
| 537,429 | 4/1895 | Alexander | 72/106 |
| 666,672 | 1/1901 | Hoffman | 72/105 |
| 1,186,145 | 6/1916 | Stowe | 72/106 |
| 1,205,605 | 11/1916 | Eligh | 72/106 |
| 1,810,342 | 6/1931 | Bulger . | |
| 2,312,225 | 2/1943 | Wilkinson | 72/106 |
| 2,506,657 | 5/1950 | Webster | 29/156 |
| 2,809,687 | 10/1957 | Ogle | 153/9 |
| 2,975,819 | 3/1961 | Costanzo et al. | 153/9 |
| 3,015,502 | 1/1962 | Frost et al. | 285/112 |
| 3,541,826 | 11/1970 | Halliburton | 72/105 |
| 3,903,722 | 9/1975 | Thau et al. | 72/105 |
| 3,995,466 | 12/1976 | Kunsman | 72/106 |
| 4,041,747 | 8/1977 | Elkin | 72/105 |
| 4,144,733 | 3/1979 | Whitten | 72/105 |

FOREIGN PATENT DOCUMENTS

| | | |
|---|---|---|
| 202712 | 11/1983 | Japan . |
| 2014072 | 7/1989 | United Kingdom . |

OTHER PUBLICATIONS

Asada, advertisement for power driven threading machine Victaulic, catalog sheet, 2 sides, for Series 226S Roll Groover, copyright 1990.

*Primary Examiner*—Lowell A. Larson

*Attorney, Agent, or Firm*—Body, Vickers & Daniels

[57] ABSTRACT

Roll grooving apparatus is pivotally mountable on the support rails of a power drive unit by which the apparatus is driven and comprises a lower support including a drive shaft driven by the power unit and including the lower grooving roll, and an upper support member pivotally interconnected with the lower support member and rotatably supporting the upper grooving roll. A lever arm is pivotally mounted on the lower support member and is interengaged with the upper support member through a pin and slot arrangement, whereby pivotal displacement of the lever arm imparts pivotal displacement to the upper support member and thus movement of the upper grooving roll toward and away from the lower grooving roll. The lower support includes a stop which limits displacement of the lever in the direction which moves the upper grooving roll towards the lower grooving roll, thus to assure a desired depth for the groove in a workpiece, and the pivotal interconnection between the upper and lower supports is adjustable to provide for adjusting the groove depth and accommodating different pipe or tube sizes and thicknesses. The adjustment enables using the stop on the lower support member as a constant in connection with pipe size and thickness variables and enables optimizing the leverage advantage and the direction of application of force of the upper grooving roll relative to the lower grooving roll.

10 Claims, 3 Drawing Sheets

FIG.

ROLL GROOVING APPARATUS

This is a continuation of Ser. No. 545,280 filed June 28, 1990, now abandoned.

BACKGROUND OF THE INVENTION

This invention relates to the art of apparatus for performing work on tubular metal workpieces and, more particularly, to improved apparatus for roll forming grooves in metal tubes or pipes.

Roll grooving apparatus is, of course, well known and, generally, includes a lower housing rotatably supporting a driven lower grooving roll, and an upper housing supporting a rotatable upper grooving roll matingly contoured with the lower roll so that a tubular workpiece therebetween is provided with a peripheral groove upon relative rotation of the grooving rolls and advancement of the upper roll towards the lower roll. Generally the lower roll is rotated by the drive motor of a power unit, and when a workpiece is interposed between the upper and lower rollers, the driven lower roller imparts rotation to the workpiece which in turn imparts rotation to the upper grooving roll, and the latter is gradually advanced towards the lower roll to progressively form the peripheral groove in the workpiece.

Heretofore, upward and downward displacement of the upper roll supporting housing has been achieved through the use of threaded feed screw arrangements between the upper and lower housings and which include a feed screw component capable of accommodating a tool such as a wrench for manually rotating the feed screw. Often, the upper and lower housings are inter-engaged for linear displacement of the upper housing toward and away from the lower housing, whereby it will be appreciated that considerable time is required to set up and to perform a roll grooving operation on a tube or pipe. In this respect, the feed screw must be manually rotated in the direction to separate the grooving rolls to facilitate the insertion of the end of a tube therebetween, and the feed screw must then be manually rotated in the opposite direction to bring the upper grooving roll into engagement with the outer surface of the workpiece. Often, the feed screw arrangement includes an adjustable stop to limit downward movement of the upper housing to control the depth of the groove which may vary from one workpiece to another depending on such factors as the diameter of the workpiece, the material of the workpiece and the wall thickness of the workpiece. Such an adjusting mechanism generally includes a threaded nut on the feed screw which is adjustably positioned therealong by manually rotating the nut, whereby it will be appreciated that further time is required to prepare the apparatus for a given roll grooving operation. Once the necessary adjustments are made, the lower grooving roll is driven to rotate the workpiece and upper grooving roll, and the feed screw is manually rotated in the direction to displace the upper housing towards the lower housing, thus to displace the upper grooving roll toward the lower grooving roll to progressively form the peripheral groove in the workpiece. When the desired groove depth is reached, driving of the lower grooving roll is stopped and the feed screw is manually rotated in the opposite direction until sufficient clearance is provided between the two rolls to accommodate removal of the grooved workpiece from therebetween.

In addition to the time required to perform a roll grooving operation, and the relatively inefficient manner of operation thereof, the time required to manually rotate feed screw arrangements for displacing the grooving rolls relative to one another can result in damage to the workpiece which renders the latter unacceptable and/or damage or undesirable wear on the component parts of the roll grooving apparatus which shorten the life thereof. More particularly in this respect, if any problems occur during the roll grooving operation it is impossible to quickly release the grooving rolls so as to preclude damage to the latter, damage to the workpiece, or the imposition of undesirable forces on the rolls and other component parts of the roll grooving apparatus which lend to damage or excessive wear thereof. For example, it is necessary for the workpiece to be properly aligned with the roll axes during a roll grooving operation so that the track of the groove is transverse to the workpiece axis. Misalignment at the beginning of the operation can cause the track of the groove to be spiral relative to the workpiece axis causing the workpiece to "walk" axially outwardly from between the grooving rolls. If the upper grooving roll is not displaced from the workpiece immediately, the workpiece can be damaged to the extent that the grooving operation cannot be completed so as to provide an acceptable end product, and/or the workpiece can drop off the end of the rolls and subject the operator to injury. While the power to the drive unit can be interrupted immediately, time is required for the momentum in the transmission to be overcome, whereby the improper tracking engagement with the workpiece does not immediately stop. Likewise, the undesirable tracking cannot be quickly stopped where displacement of the upper grooving roll from engagement with the workpiece requires manual rotation of a threaded feed screw, especially if the operator is using a ratchet wrench and has to first reverse the wrench drive and then begin the reverse rotation of the feed screw.

In other roll grooving apparatus heretofore provided, the upper grooving roll supporting housing is pivotally attached to the lower housing, but displacement of the upper housing toward and away from the lower housing is still accommodated through the use of a feed screw arrangement. Therefore, the time required to space the grooving rolls for the insertion of a workpiece therebetween, as well as the time required to perform a roll grooving operation, is basically the same as with apparatus in which the housing members are linearly displaceable relative to one another. Moreover, for the same reasons discussed above, the feed screw arrangement is unsafe from the standpoint of the inability to quickly release the grooving rolls or otherwise interrupt the roll grooving operation.

Other problems attendant to both of the foregoing feed screw type roll groovers result from the fact that considerable torque is required to be applied to the feed screw during a roll grooving operation and is applied by the operator by rotating the feed screw about a vertical axis. It will be appreciated that the force required to achieve such rotation results in the imposition of directional forces against the apparatus in a horizontal plane which tend to promote misalignment between the apparatus and workpiece. This in turn promotes "walking" of the workpiece, especially at the beginning of the roll grooving operation. Such application of horizontal directional forces is of further concern from the standpoint of operator safety because there is the potential for tipping the apparatus, especially when the directional force is lateral to the working axis. Moreover, the rotational force which must be applied to the feed screw by the operator promotes the latter's imbalance during a roll grooving operation which is both tiring and hazardous from the standpoint of operator safety.

In a manner similar to the latter roll grooving apparatus, it is known to provide a pipe or tube cutter with a cutter wheel pivotally mounted on a support member for displacement toward and away from supporting rollers. A workpiece to be cut is interposed between the supporting rollers and cutting wheel and, in a manner similar to that described above, the pivotally mounted cutting wheel is advanced toward the rollers and against the workpiece by a feed screw mechanism during relative rotation between the workpiece and the cutting apparatus. Thus, as with the similar roll grooving apparatus, it is not possible to quickly disengage the cutting wheel from the workpiece during a cutting operation should it become necessary or desirable to do so and, following the cutting operation, it is necessary to manually rotate the feed screw mechanism in the opposite direction to reset the cutting wheel for the next cutting operation.

SUMMARY OF THE INVENTION

In accordance with the present invention, roll grooving apparatus is provided which advantageously minimizes or overcomes the foregoing and other problems and disadvantages encountered in connection with roll grooving apparatus heretofore available. More particularly in this respect, the support for the upper grooving roll in accordance with the present invention is mounted on the support for the lower grooving roll in a manner whereby the upper grooving roll is pivotal toward and away from the lower grooving roll, and a manually actuated lever arrangement is provided for imparting pivotal movement to the upper support member and thus the upper grooving roll. The lever arrangement advantageously avoids having to manipulate the upper roll support through the use of a feed screw arrangement and, in connection with the preparation for and performance of a roll grooving operation, minimizes the time and effort required on the part of the operator. In this respect, the upper grooving roll is readily displaced away from the lower grooving roll by the lever mechanism to facilitate the introduction of a workpiece therebetween and, likewise, the upper grooving roll is readily displaced toward the workpiece and lower grooving roll to initiate the roll grooving operation. Furthermore, the latter is achieved with less physical effort on the part of the operator and in less time in that the rotating of a feed screw through a wrench or the like is replaced by simple pivotal displacement of a lever arm to advance the upper grooving roll toward the lower grooving roll to progressively produce the peripheral groove in the workpiece therebetween. It will be appreciated too that the lever arm advantageously enables multiplying the working force applied to the upper grooving roll relative to the force applied to the lever arm by the operator, thus to further facilitate the ease with which roll grooving is achieved.

In addition to the foregoing advantages in connection with the preparation and performance of a roll grooving operation, the lever arrangement advantageously enables the operator to immediately disengage the upper grooving roll from the workpiece should a problem such as mis-tracking occur, thus to minimize or avoid damage to the workpiece. Moreover, such immediate release of engagement between the upper grooving roll and the workpiece can be achieved at any time during a roll grooving operation should it become necessary or desirable to do so. In addition to protecting the workpiece and/or component parts of the roll grooving apparatus from damage, the quick release afforded by lever actuation of the upper grooving roll provides improved safety for the operator by avoiding potential injury which could result from the workpiece walking off the end of the lower grooving roll, and by avoiding the operator having to use a tool such as a wrench to rotate a feed screw and which tool can both interfere with the operator's concentration and can become disengaged from the feed screw and accidentally dropped into the vicinity of the rotating parts and workpiece.

Preferably, the pivotal connection between the support for the upper grooving roll and the support for the lower grooving roll is adjustable to facilitate varying the depth of the groove in a workpiece and to better accommodate workpieces of different diameter and having different wall thicknesses. Further, the adjustment enables maintaining an alignment between the upper and lower grooving rolls which optimizes the directional application of force therebetween during a grooving operation thus optimizing the lever advantages. Still further, the adjustment capability enables providing the apparatus with a fixed or constant stop point for the lever arm in the direction of displacement thereof in performing a roll grooving operation.

Accordingly, it is an outstanding object of the present invention to provide improved roll grooving apparatus for roll forming a peripheral groove in a tubular metal workpiece.

Another object is the provision of roll grooving apparatus of the foregoing character which is structured to minimize the time and effort required to prepare the apparatus for and to perform a roll grooving operation on a workpiece.

A further object is the provision of roll grooving apparatus of the foregoing character which is structured to provide for the immediate release of the working engagement between the grooving rolls and a workpiece therebetween at any time during a roll grooving operation.

Still another object is the provision of roll grooving apparatus of the foregoing character comprising upper and lower grooving rolls and wherein the upper grooving roll is supported for pivotal displacement toward and away from the lower grooving roll through a lever arrangement which optimizes the application of force to the displaceable upper grooving roll and facilitates immediate release of the force at any time during a roll forming operation.

Yet another object is the provision of roll grooving apparatus of the foregoing character wherein the pivot axis for the upper grooving roll support is adjustable to facilitate the roll grooving of workpieces of different diameter and wall thickness and to vary the groove depth while optimizing the directional application of the roll grooving force between the lower and upper grooving rolls.

A further object is the provision of roll grooving apparatus of the foregoing character which is portable, structurally compact, more efficient in operation than roll grooving apparatus heretofore available and which provides improved operator safety as well as the ability to minimize damage to workpieces and/or damage or excessive wear to the grooving rolls and other component parts of the apparatus in the event of problems occurring during the roll grooving operation.

BRIEF DESCRIPTION OF THE DRAWINGS

The foregoing objects, and others, will in part be obvious and in part pointed out more fully hereinafter in conjunction with the written description of a preferred embodiment of the invention shown in the accompanying drawings in which.

DESCRIPTION OF THE PREFERRED EMBODIMENT

Figure 1:
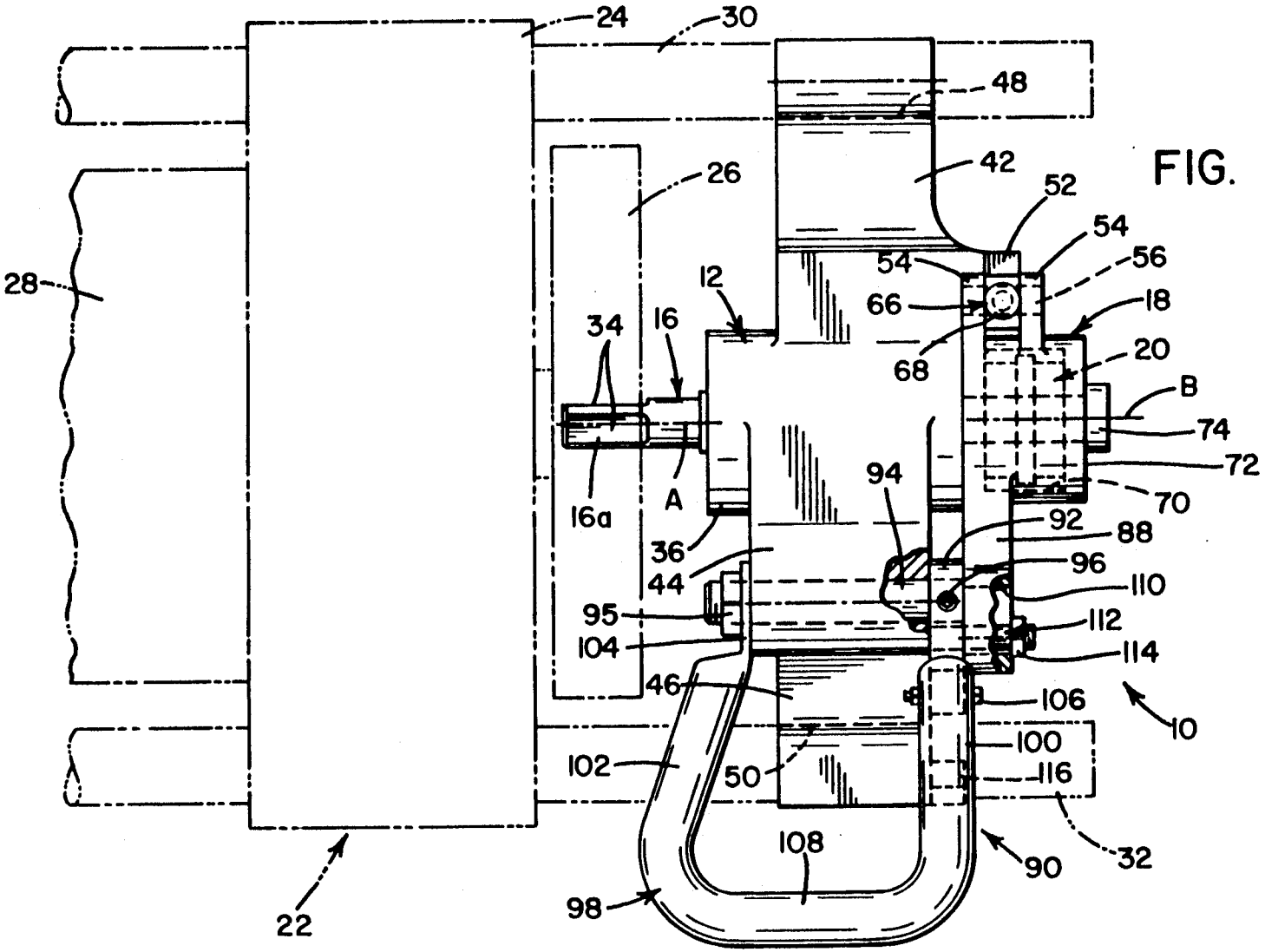
FIG. 1 is a plan view of roll grooving apparatus in accordance with the present invention.

Referring now in greater detail to the drawings, wherein the showings are for the purpose of illustrating a preferred embodiment of the invention only, and not for the purpose of limiting the invention, roll grooving apparatus 10 according to the present invention comprises a lower support member 12 rotatably supporting a lower grooving roll 14 which is integral with a drive shaft 16 for the apparatus, and an upper support member 18 rotatably supporting an upper grooving roll 20. In the embodiment shown in the drawings, roll grooving apparatus 10 is adapted to be supported on and driven by a power drive unit shown schematically in FIG. 1 and designated generally by the numeral 22. As is well known, such a drive unit includes a housing 24 adapted to be mounted on a bench or stand, and a rotatable chuck mechanism 26 driven by an electric motor 28 through a suitable gear transmission in the housing. Housing 24 also supports a pair of tubular members 30 and 32 which are laterally spaced apart and parallel to one another and which extend forwardly of the power drive unit to in turn support roll grooving apparatus 10 in the manner set forth more fully hereinafter. Chuck mechanism 26 of the power drive unit has an axis, and when the roll grooving apparatus is mounted on supports 30 and 32 the chuck axis is coaxial with the axis A of drive shaft 16. As is further well known, chuck mechanism 26 has a plurality of workpiece-engaging jaws, not shown, adapted to engage and rotate drive shaft 16 through driven end **16*a* thereof to drive the roll grooving apparatus when motor 28 is energized. Preferably, driven end 16*a* is provided with flats 34** to optimize the driving interengagement between the chuck jaws and drive shaft.

Figure 2:
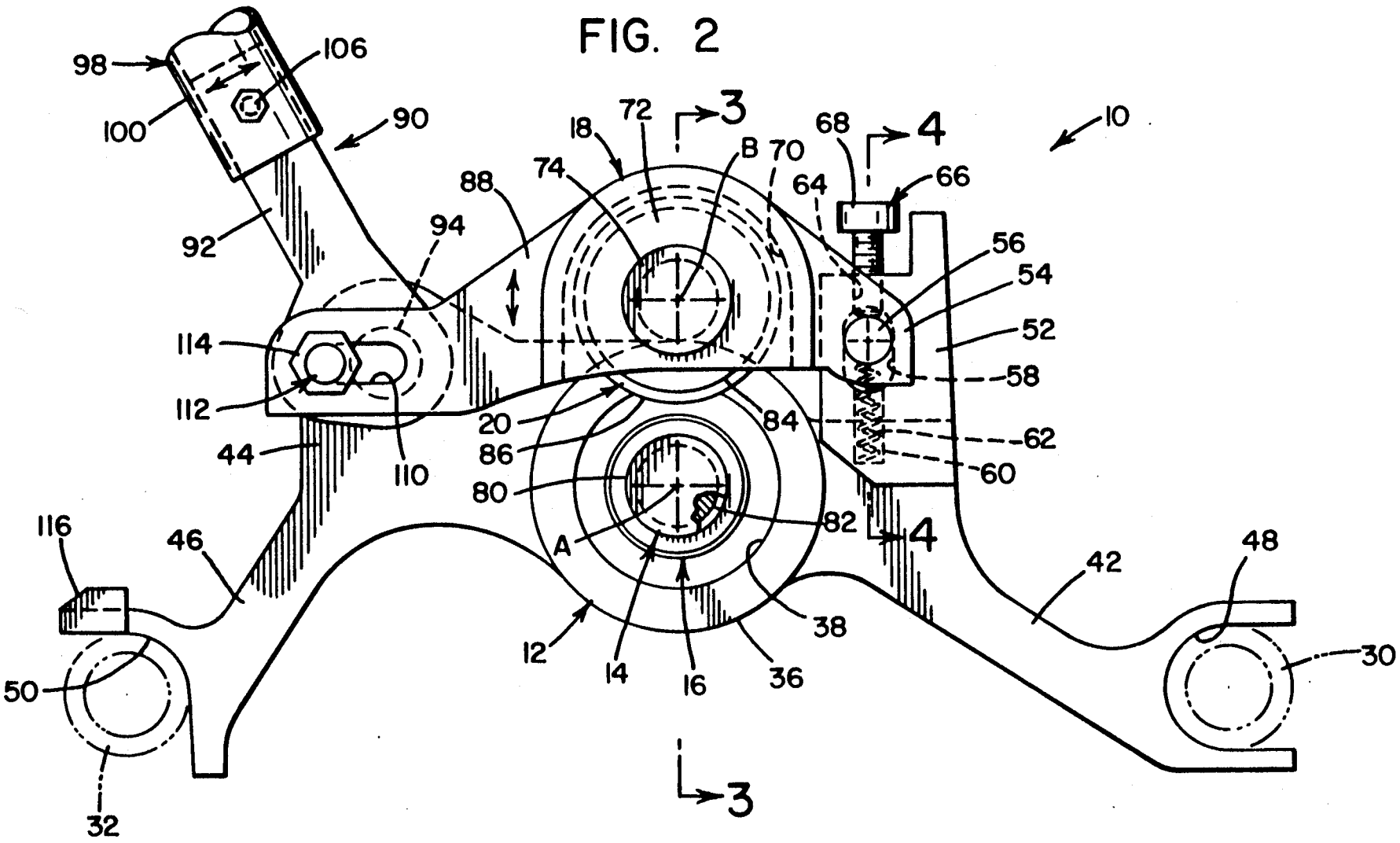
FIG. 2 is an enlarged end elevation view of the roll grooving apparatus looking in the direction from right to left in FIG. 1.
Figure 3:
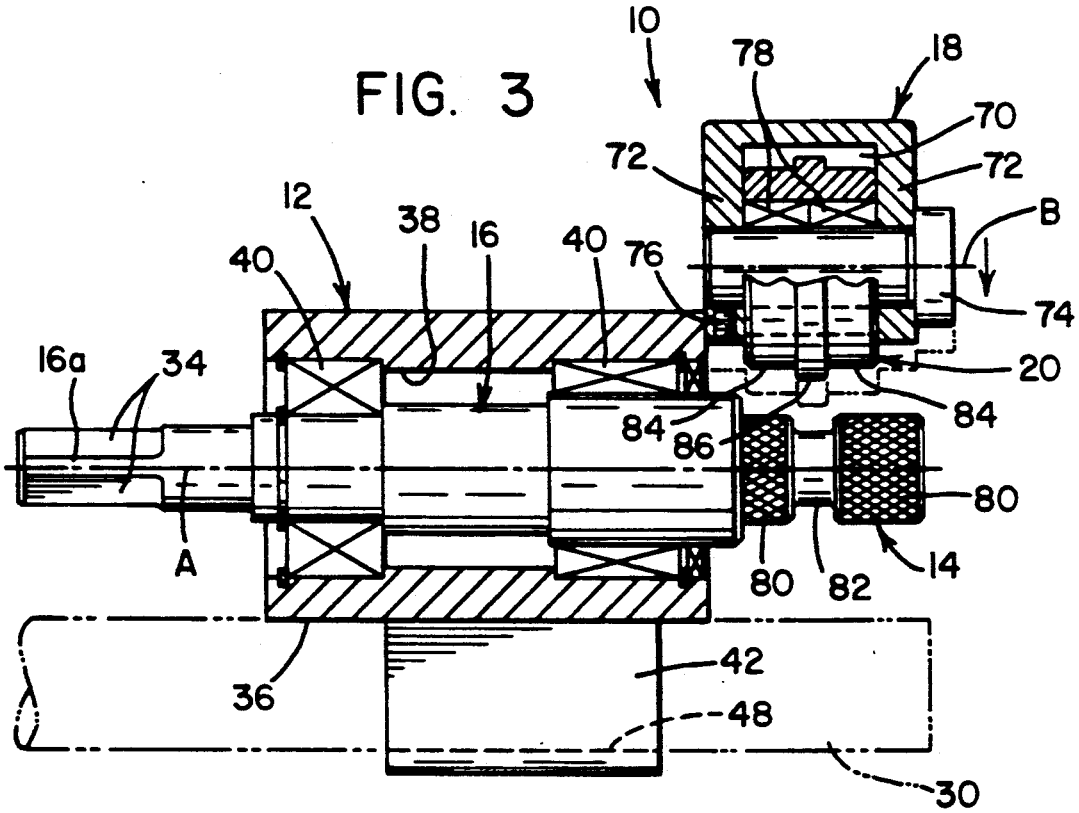
FIG. 3 is a sectional elevation view of the apparatus taken along line 3—3 in FIG. 2.

As best seen in FIGS. 2 and 3 of the drawings, lower support member 12 includes a circular body portion 36 having a bore 38 extending axially therethrough and in which drive shaft 16 is supported for rotation by bearing assemblies 40. The lower support member further includes a support leg 42 integral with and extending laterally from one side of body portion 36, and a lever supporting portion 44 extending laterally from the opposite side of body portion 36 and terminating in a support leg 46. As seen in FIG. 2, the laterally outer end of support leg 42 is provided with an outwardly open U-shaped recess 48 which receives support tube 30 when the apparatus is mounted on the drive unit, and support leg 46 is provided with an outwardly and downwardly open recess 50 which receives support tube 32 when the apparatus is mounted on the drive unit. As will be appreciated from FIG. 2, the recesses 48 and 50 advantageously facilitate the quick mounting and dismounting of roll grooving apparatus 10 relative to drive unit 22. In this respect, assuming the component parts to be in the positions shown in FIGS. 1 and 2, and further assuming the chuck jaws to be released with respect to driven end **16*a* of drive shaft 16, it is only necessary to slide roll grooving apparatus 10 outwardly along support tubes 30 and 32 until driven end 16*a* clears chuck assembly 26, whereupon clockwise displacement of the apparatus from the position shown in FIG. 2 disengages recess 50 from support tube 32 and facilitates removal of the apparatus by withdrawing recess 48 from engagement with support tube 30**.

Figure 4:
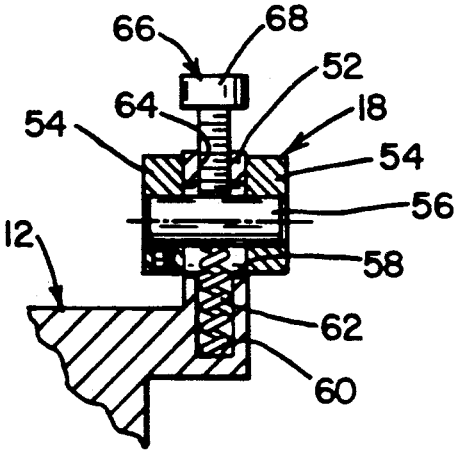
FIG. 4 is a sectional elevation view taken along line 4—4 in FIG. 2 and showing the mechanism for adjusting the pivot axis between the upper and lower support members of the apparatus.

Lower housing member 12 further includes an upwardly extending leg 52 adjacent the axially forward end thereof and laterally offset from axis A on one side thereof, and upper support member 18 has its corresponding end laterally slotted to provide a pair of legs 54 receiving leg 52 therebetween. Upper support member 18 is pivotally interconnected with lower support member 12 by means of a pin 56 providing a pivot axis parallel to axis A and spaced above a horizontal plane through axis A. As best seen in FIG. 4, pin 56 extends through openings therefor in legs 54 and through a vertically elongated slot 58 in leg portion 52 of lower support member 12 and is vertically slidable in slot 58. Leg portion 52 of lower support member 12 is provided with a vertical bore having a lower end 60 below slot 58 and a compression spring 62 is received in lower end 60 and engages under pin 56. The vertical bore has a threaded upper end 64 receiving a matingly threaded shank portion of an adjusting screw 66. Screw 66 has an inner end engaging against the upper side of pin 56 and an operating knob 68 at the outer end thereof. Adjusting screw 66, spring 62 and slot 58 provide for adjusting the vertical position of pin 56 and thus the pivot axis for upper support member 18 relative to axis A for the purpose set forth hereinafter.

Upper support member 18 extends laterally across axis A from pin 56 and includes a downwardly open chamber 70 receiving upper grooving roll 20. Chamber 70 includes axially spaced apart walls 72 apertured to receive an upper grooving roll shaft member 74 which is releasable secured thereto such as by a set screw 76. Shaft member 74 has an axis B parallel to axis A, and upper grooving roll 20 is supported for rotation relative to shaft 74 by bearings 78 therebetween. As best seen in FIG. 3, lower grooving roll 14 includes axially spaced apart circular portions 80 and a peripheral recess 82 therebetween, and upper grooving roll 20 is of a mating contour and, accordingly, includes circular portions 84 overlying portions 80 of the lower grooving roll, and a radial circular projection 86 therebetween overlying recess 82 in the lower grooving roll. The circular surfaces 80 on lower grooving roll 14 are knurled to enhance the driving interengagement thereof with the inner surface of a workpiece to be grooved.

Upper support member 18 further includes an arm 88 extending laterally outwardly with respect to axis A on the side thereof opposite the location of pivot pin 56, and the laterally outer end of arm 88 is interconnected with a lever assembly 90 in a manner whereby the latter is operable to pivotally displace upper support member 18 in opposite directions about the axis of pin 56, thus to displace the upper grooving roll 20 toward and away from the lower grooving roll 14. More particularly in this respect, lever assembly 90 includes a lever arm 92 pivotally mounted on portion 44 of lower support member 12 by means of a pivot pin 94 parallel to axis A and extending through openings therefor in the support portion 44 and lever arm 92. The lever arm is releasably secured to pi 94 such as by a set screw 96. In the embodiment illustrated, lever arm 92 is disposed against the axially outer side of portion 44 of lower support member 12 and, preferably, the lever assembly includes a generally U-shaped handle 98 having a first leg 100 receiving the outer end of lever arm 92 and a second leg 102 having a flattened end 104 apertured to receive pivot pin 94. Preferably, pin 94 receives a nut 95 engaging against the outer side of flattened portion 104 to axially retain the latter. Further, leg 100 of handle 98 is slightly flattened to matingly engage with the axially opposite sides of lever arm 92 and is suitably secured thereto such as by a threaded bolt 106. The bridging portion 108 between handle legs 100 and 102 is preferably straight and of a sufficient length to provide for the operator to comfortably grip and actuate the lever mechanism.

The laterally outer end of arm 88 of upper support member 18 is provided with an elongated slot 110, and the upper support member is pivotally interconnected with lever arm 92 by means of a pin 112 parallel to axis A and having its inner end suitably secured to lever arm 92 such as by means of a set screw, not shown. Pin 112 extends outwardly through slot 110 and receives a nut 114 engaging against the axially outer side of arm 88 of upper support member 18. As will be appreciated from FIG. 2, pin 112 is laterally offset from lever pivot pin 94 and provides a cam element, and slot 110 provides a cam track for the pin. Accordingly, pivotal displacement of lever arm 92 clockwise about pivot pin 94 causes upper support member 18 to pivot clockwise about pivot pin 56 to displace upper grooving roll 20 upwardly away from lower grooving roll 14, and pivotal displacement of lever arm 92 counterclockwise in FIG. 2 operates to displace upper grooving roll 20 downwardly toward lower grooving roll 14. Counterclockwise displacement of lever arm 92 about the axis of pin 94 is limited by a stop element 116 which projects axially forwardly from support leg 46 of lower support member 12 to underlie lever arm 92 with respect to the latter's path of movement counterclockwise about pin 94.

It is believed that the operation of roll grooving apparatus 10 will be apparent from the foregoing description. Briefly in this respect, the operator adjusts the position of pivot pin 56 by rotation of adjusting screw 66 to a predetermined position relative to axis A for obtaining a desired groove depth for a given workpiece diameter and wall thickness. The operator then grasps the outer end 108 of handle 98 and displaces the latter and thus lever arm 92 clockwise about the axis of pivot pin 94 to displace upper support member 18 and thus upper grooving roll 20 upwardly away from lower grooving roll 14. The workpiece to be grooved is then axially introduced over lower grooving roll 14 and between the upper and lower grooving rolls, and handle 98 is displaced counterclockwise in FIG. 2 to lower the upper grooving roll into engagement with the outer surface of the workpiece. The power drive is then actuated to rotate drive shaft 16 and thus lower grooving roll 14. The outer surface of lower grooving roll 14 is in contact with the inner surface of the workpiece, whereby rotation of the lower grooving roll imparts rotation to the workpiece, and upper grooving roll 20 is rotated by the rotating workpiece through the engagement of grooving projection 86 with the outer surface of the workpiece. The operator then gradually pivots handle 98 and thus lever arm 92 in the counterclockwise direction in FIG. 2, whereby upper roll projection 86 and lower roll recess 82 cooperatively inter-engage with the wall of the workpiece therebetween to progressively form the desired peripheral groove in the workpiece. The grooving operation is completed when the lever arm engages stop 116, whereupon the operator pivots the handle clockwise about the axis of pin 94 to separate the grooving rolls and facilitate removal of the grooved workpiece from between the rolls. It is likewise believed to be readily apparent from the drawings and the foregoing description that the roll grooving apparatus according to the present invention enables the immediate release of the working force and displacement of the upper grooving roll away from the lower grooving roll in the event any problems are encountered during a roll grooving operation which could potentially injure the operator, or damage the workpiece and/or component parts of the roll grooving apparatus.

While considerable emphasis has been placed herein on the preferred embodiment of the roll grooving apparatus and the structural interrelationships between the component parts thereof, it will be appreciated that other embodiments of the invention can be made and that modifications of the preferred embodiment can be made without departing from the principles of the invention. For example, it will be appreciated that the lever arm and handle assembly could be of one piece construction and that the pin and slot arrangement between the lever arm and upper support member could be reversed, or replaced by other cam and cam track arrangements. Likewise, the pivot pin and slot arrangement for adjusting the pivot axis between the upper and lower roll supports can be reversed, or replaced by other adjusting arrangements. These and other modifications of the preferred embodiment will be suggested or obvious to those skilled in the art from the present disclosure, whereby it is to be distinctly understood that the foregoing descriptive matter is to be interpreted merely as illustrative of the present invention and not as a limitation.

Having thus defined the invention, the following is claimed:

1. In portable roll grooving apparatus for rolling a circumferential groove in a pipe, said apparatus being of the character removably mountable on separate support and drive means including spaced apart and parallel support elements and drive motor means having drive coupling means and a coupling axis between and parallel to said support elements, and said apparatus including a lower support member having opposite ends slidably supportable on said support elements and front and rear sides with respect to said drive motor means, shaft means rotatably supported in said lower support member and having a shaft axis coaxial with said coupling axis and front and rear ends extending respectively from said front and rear sides, a lower grooving roll on said front end of said shaft means for rotation therewith and means on said rear end of said shaft means for coupling engagement with said drive coupling means, an upper support member having a first end interconnected with said lower support member for pivotal displacement of said upper support member relating to said lower support member about a pivot axis parallel to and laterally offset from one side of said shaft axis, said upper support member extending across said shaft axis from said pivot axis and having a second end laterally spaced from said shaft axis on the side thereof opposite said one side, and an upper grooving roll supported on said upper support member between said first and second ends thereof for idling rotation about an upper roll axis parallel to and vertically above said shaft axis, the improvement comprising: a hand lever mounted on said lower support member for pivotal displacement about a lever axis parallel to and laterally spaced from said shaft axis in the direction toward said second end of said upper support member, and means interconnecting said hand lever and said second end of said upper support member for pivotal displacement of said hand lever about said lever axis to pivotally displace said upper support member about said pivot axis to move said upper grooving roll vertically and radially toward and away from said lower grooving roll.

2. Portable roll grooving apparatus according to claim 1, wherein said pivot axis for said upper support member is vertically adjustable.

3. Portable roll grooving apparatus according to claim 1, wherein said means interconnecting said hand lever and said second end of said upper member includes cam means.

4. Portable roll grooving apparatus according to claim 3, and stop means on said lower support member to limit pivotal movement of said hand lever in the direction moving said upper grooving roll toward said lower grooving roll.

5. Portable roll grooving apparatus according to claim 3, wherein said cam means includes a cam pin on said hand lever and a slot in said second end of said upper support member slidably receiving said cam pin.

6. Portable roll grooving apparatus according to claim 1, wherein said pivot axis is spaced above a horizontal plane through said shaft axis, said pivot axis being provided by a pivot pin on said first end of said upper support member, a vertical slot in said lower support member slidably receiving said pivot pin, and means for adjusting the vertical position of said pivot pin in said slot.

7. Portable roll grooving apparatus according to claim 6, wherein said slot has upper and lower ends, and said means for adjusting the position of said pivot pin includes spring means biasing said pivot pin toward said upper end of said slot and adjusting screw means for displacing said pivot pin toward the bottom end of said slot against the bias of said spring means.

8. Portable roll grooving apparatus according to claim 7, wherein said means interconnecting said hand lever and said second end of said upper member includes cam means.

9. Portable roll grooving apparatus according to claim 8, wherein said cam means includes a cam pin on said hand lever and a slot in said second end of said upper support member slidably receiving said cam pin.

10. Portable roll grooving apparatus according to claim 1, wherein one of said opposite ends of said lower support member has an outwardly open recess therein, and the other of said opposite ends has an outwardly and downwardly open recess therein.

* * * * *